US007328524B2

(12) United States Patent
Lebo

(10) Patent No.: US 7,328,524 B2
(45) Date of Patent: Feb. 12, 2008

(54) SHOE WITH IMPROVED VENTILATION

(75) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 373 days.

(21) Appl. No.: 11/030,518

(22) Filed: Jan. 6, 2005

(65) Prior Publication Data

US 2006/0143942 A1 Jul. 6, 2006

(51) Int. Cl.
*A43B 5/16* (2006.01)

(52) U.S. Cl. ..... 36/3 R; 36/3 B; 36/30 R

(58) Field of Classification Search ..... 36/3 R, 36/3 B, 25 R, 30 R
See application file for complete search history.

(56) References Cited

U.S. PATENT DOCUMENTS

| | | | | | |
|---|---|---|---|---|---|
| 1,742,772 | A | * | 1/1930 | Langan et al. | 36/3 B |
| 1,974,456 | A | * | 9/1934 | Goldzwcig | 36/3 R |
| 2,205,753 | A | * | 6/1940 | Svrlinga, Jr. | 36/3 R |
| 2,207,632 | A | * | 7/1940 | Meyer | 36/3 R |
| 4,100,685 | A | | 7/1978 | Dassler | 36/3 B |
| 4,232,458 | A | | 11/1980 | Bartels | 36/45 |
| 4,290,211 | A | * | 9/1981 | Csengeri | 36/3 B |
| 4,417,407 | A | | 11/1983 | Fukuoka | 36/3 B |
| 4,438,574 | A | | 3/1984 | Johnson | 36/45 |
| 4,507,880 | A | * | 4/1985 | Ohashi | 36/115 |
| 4,541,186 | A | | 9/1985 | Malvihill | 36/114 |
| 4,693,021 | A | | 9/1987 | Mazzarolo | 36/131 |
| 4,771,555 | A | * | 9/1988 | Ohashi | 36/3 R |
| 4,813,158 | A | | 3/1989 | Brown | 36/114 |
| 4,835,883 | A | | 6/1989 | Tetrault et al. | 36/3 R |
| 4,837,948 | A | | 6/1989 | Cho | 36/3 A |
| 4,888,887 | A | | 12/1989 | Solow | 36/3 R |
| 4,912,858 | A | | 4/1990 | Mochizuki | 36/3 B |
| 5,044,096 | A | * | 9/1991 | Polegato | 36/3 R |
| 5,086,572 | A | | 2/1992 | Lee | 36/3 R |
| 5,086,576 | A | | 2/1992 | Lamson | 36/131 |
| 5,220,791 | A | | 6/1993 | Bulzomi | 36/3 B |
| 5,357,689 | A | | 10/1994 | Awai | 36/3 A |
| 5,392,535 | A | | 2/1995 | Van Noy et al. | 36/88 |
| 5,551,172 | A | | 9/1996 | Yu | 36/3 A |
| 5,564,203 | A | | 10/1996 | Morris | 36/50.1 |
| 5,598,644 | A | | 2/1997 | Polegato | 36/3 B |
| 5,784,806 | A | | 7/1998 | Wendt | 36/2 R |
| 5,992,052 | A | | 11/1999 | Moretti | 36/3 B |
| 6,108,943 | A | | 8/2000 | Hudson et al. | 36/102 |
| 6,256,824 | B1 | | 7/2001 | Austin et al. | 12/142 P |
| 6,282,813 | B1 | | 9/2001 | Squadroni | 36/3 B |
| 6,401,364 | B1 | | 6/2002 | Burt | 36/3 A |
| 6,477,793 | B1 | | 11/2002 | Pruitt et al. | 36/131 |
| 6,553,690 | B2 | | 4/2003 | DiGirolamo | 36/3 R |

(Continued)

FOREIGN PATENT DOCUMENTS

| | | |
|---|---|---|
| WO | WO 98/14081 | 4/1998 |
| WO | WO 98/29000 | 7/1998 |

*Primary Examiner*—Marie Patterson
(74) *Attorney, Agent, or Firm*—St. Onge Steward Johnston & Reens LLC

(57) ABSTRACT

The invention relates to a sole that includes a bottom surface, a top surface, and a shaft extending upwardly from the top surface. The shaft further includes an upper surface and an elongated hole extending from the upper surface to the bottom surface through the sole and shaft.

15 Claims, 3 Drawing Sheets

U.S. PATENT DOCUMENTS

| | | | | |
|---|---|---|---|---|
| 6,711,832 | B2 * | 3/2004 | Chen | 36/3 R |
| 2001/0001904 | A1 | 5/2001 | Hernadez | 36/28 |
| 2002/0011009 | A1 | 1/2002 | Pan | 36/3 B |
| 2002/0157278 | A1 | 10/2002 | Moretti | 3/3 |
| 2005/0172513 | A1 * | 8/2005 | Lechhart et al. | 36/3 B |

* cited by examiner

SHOE WITH IMPROVED VENTILATION

FIELD OF THE INVENTION

The invention relates to a shoe having improved ventilation.

BACKGROUND OF THE INVENTION

Traditional footwear often have a drawback of reduced ventilation because confining the foot usually does not allow sufficient breathability, which may cause the foot to perspire and may also promote the development of bacteria, fungi and the like as well as any accompanying unpleasant odors and skin problems.

Later developed footwear typically attempted to solve the lack of sufficient breathability by ventilating the shoe. Some constructions have openings in the upper but may also allow debris and water to enter the shoe. U.S. Pat. No. 6,564,475 to Collins, U.S. Pat. No. 5,086,576 to Lamson, U.S. Pat. No. 6,553,690 to Di Girolamo, and U.S. Pat. No. 5,992,052 to Morris appear to relate to footwear with vent holes in the upper, sole, or both. Another disadvantage may be that although the shoe has vent holes in either the upper or sole, breathability may still be inadequate since the shoe lacks a mechanism that draws atmospheric air into the shoe and expels hot air from within the shoe.

Complicated valve arrangements may have been provided by other constructions to open and close an opening to reduce the amount of debris or water entering the shoe. However, these types of footwear may generally be more expensive to purchase. U.S. Pat. No. 6,282,813 to Squadroni and U.S. Pat. No. 5,992,052 to Moretti appear to relate to footwear having valves for venting the shoe.

Other approaches may include a pump encased within the shoe, sometimes in communication with openings in the upper. Generally, the weight of the foot is used to compress the pump and force air out of apertures to ventilate the foot. However, problems may arise if the pump fails to reinflate, which often occurs because the foot is typically placed on top of the pump and prevents full inflation. Moreover, such mechanisms are typically prohibitively expensive to build into footwear and, given that most of these devices are built into the shoe, they are not easily repairable or replaceable. U.S. Pat. No. 4,835,883 to Tetrault and U.S. Pat. No. 4,776,110 to Shiang and U.S. Publication No. 2002/0011009 to Pan appear to relate to footwear having pumps.

What is desired, therefore, is a shoe that has a ventilation system that cools the user's foot and provides sufficient breathability. What is also desired is a shoe with a ventilation system that reduces the amount of debris or water that enters the shoe. A further desire is a shoe that has a ventilation system that is reliable and inexpensive.

SUMMARY OF THE INVENTION

It is therefore an object of the invention to provide a shoe that sufficiently ventilates the foot.

It is another object of the invention to provide a shoe that reduces the amount of water or debris from entering the shoe through apertures in the shoe.

It is a further object of the invention to provide a shoe that repeatedly vents the foot in a reliable and inexpensive manner.

These and other objects of the invention are achieved by a sole that includes a bottom surface, a top surface, and a shaft extending upwardly from the top surface. The shaft further includes an upper surface and a hole extending from the upper surface to the bottom surface through the sole and shaft.

The sole may also have a first filter on the upper surface for inhibiting debris from entering a shoe through the hole. In some aspects of the invention, the sole may also have a second filter placed on a side of the first filter opposite the sole for further inhibiting debris from entering the shoe through the hole and first filter, wherein the second filter has at least one aperture of a different size than at least one aperture of the first filter.

In some versions of the sole, the upper surface is between approximately ⅜ inches and approximately ⅞ inches away from the bottom surface for inhibiting water or debris from entering a shoe. In further versions, the upper surface is between approximately ½ inches and approximately ¾ inches away from said bottom surface for creating a vacuuming effect that promotes air to enter the shoe through the hole. In other versions of the sole, the hole is between approximately 1½ inches and approximately 3 inches long.

In a more specific aspect of the invention, a socklining may extend over the top surface and is adapted to receive a user's foot. Additionally, a spacer, preferably made of resilient material, extends from the socklining upwardly to the top surface to cushion the user's foot. In the versions of the invention that have first and second filters, the second filter is optionally secured to the socklining to facilitate placement.

DETAILED DESCRIPTION OF THE DRAWINGS

Figure 1:
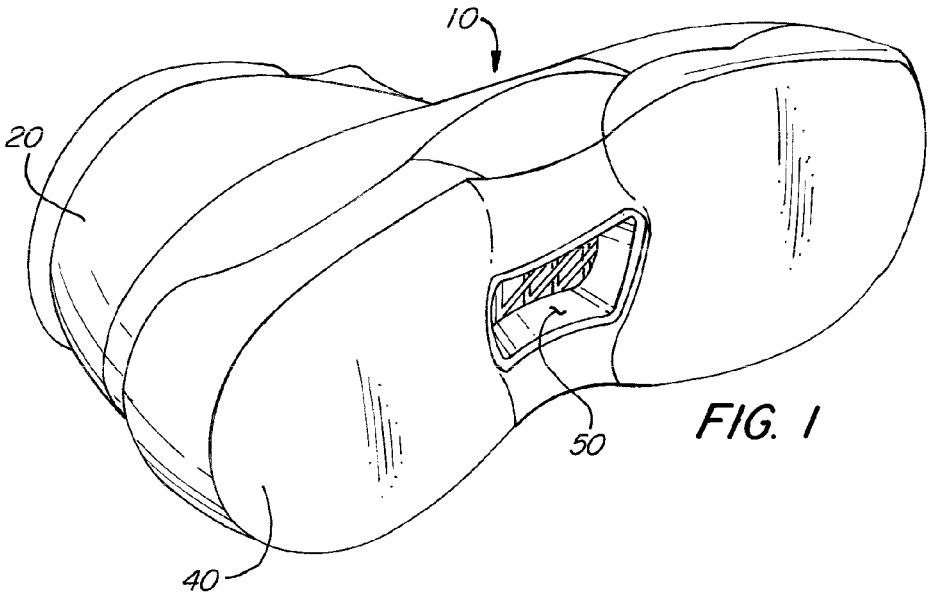
FIG. 1 depicts the shoe in accordance with the invention.
Figure 2:
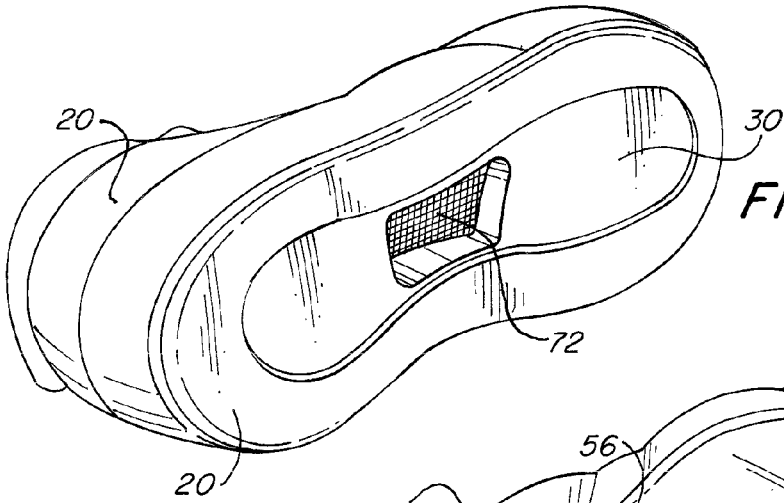
FIG. 2 depicts the upper, cushion, and second filter of the shoe shown in FIG. 1.

FIG. 1 depicts shoe 10 in accordance with the invention. Shoe 10 includes upper 20, cushion 30 (see FIG. 2), sole 40, and air shaft 50 for venting the interior of shoe 10. As shown in FIGS. 2-5, shaft 50 includes upper surface 52, above which first filter 56 is placed for reducing the amount of unwanted debris from entering shoe 10 through air shaft 50. A second filter 72 is placed above filter 56 for reducing smaller debris that may have passed through first filter 56.

As shown, second filter 72 is attached to socklining 70 but this is not required as, in other embodiments, second filter 72 is separate from socklining 70. To further enhance comfort and cushion to a user's foot, a footbed is placed on top of socklining 70 to directly receive the foot. Because second filter 72 is sewn to socklining 70 to maintain the position of second filter 72 above shaft 50, socklining 70 is of a thin material, relative to the footbed, for manufacturing purposes. However, in another embodiment, second filter 72 may be secured to a thicker, more comforting socklining 70 that is adapted to be in direct contact with the foot, in which case the need for the footbed is obviated.

Figure 3:
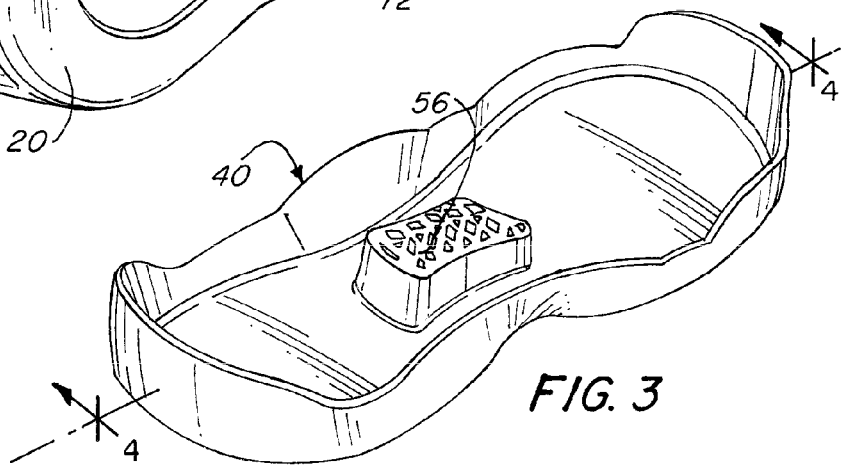
FIG. 3 depicts the sole of the shoe shown in FIG. 1.
Figure 4:
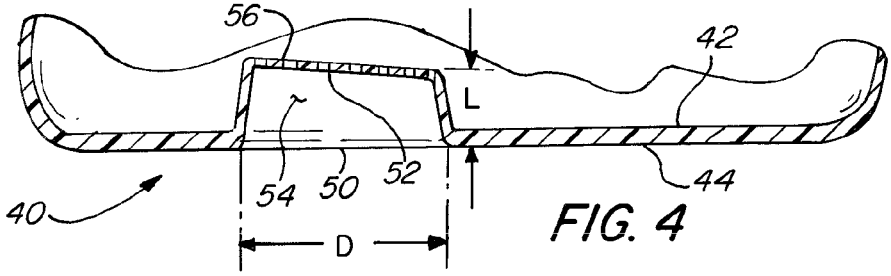
FIG. 4 depicts a cross sectional view of the sole of the shoe shown in FIG. 1.
Figure 5:
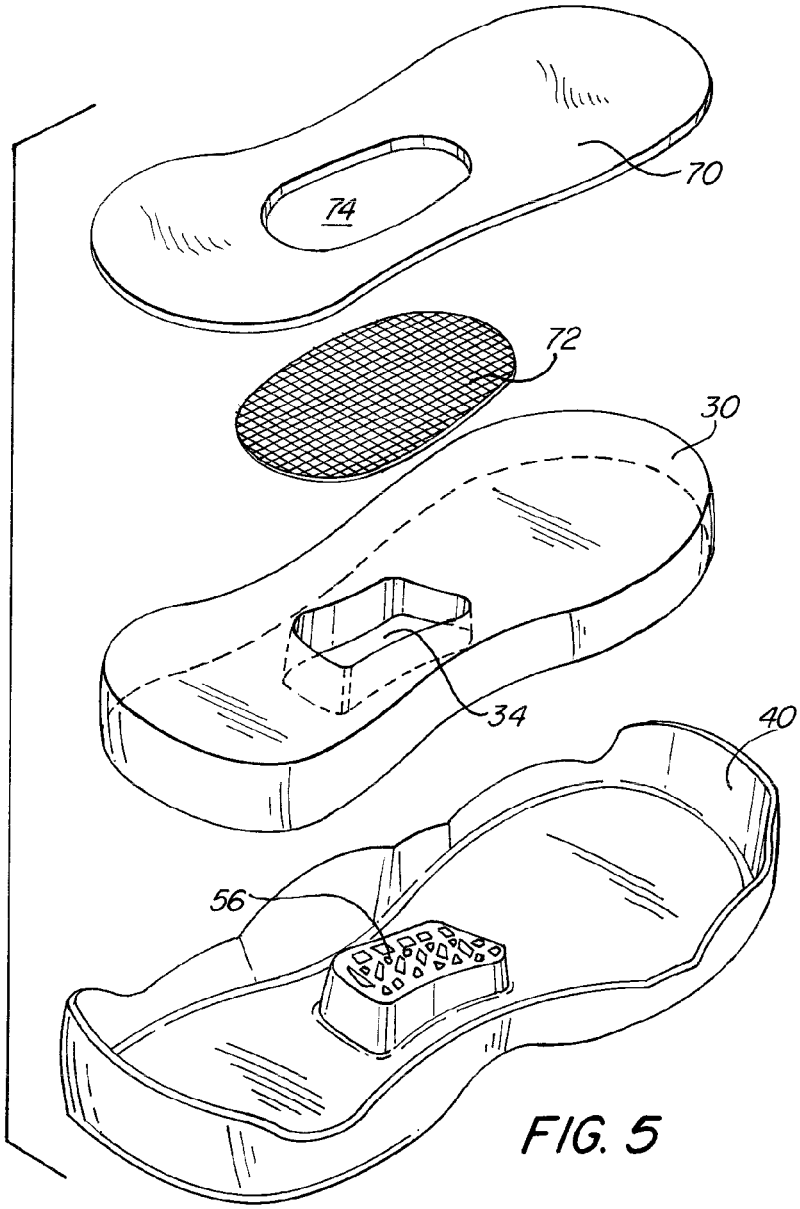
FIG. 5 depicts an assembly view of the shoe shown in FIG. 1.
Figure 6:
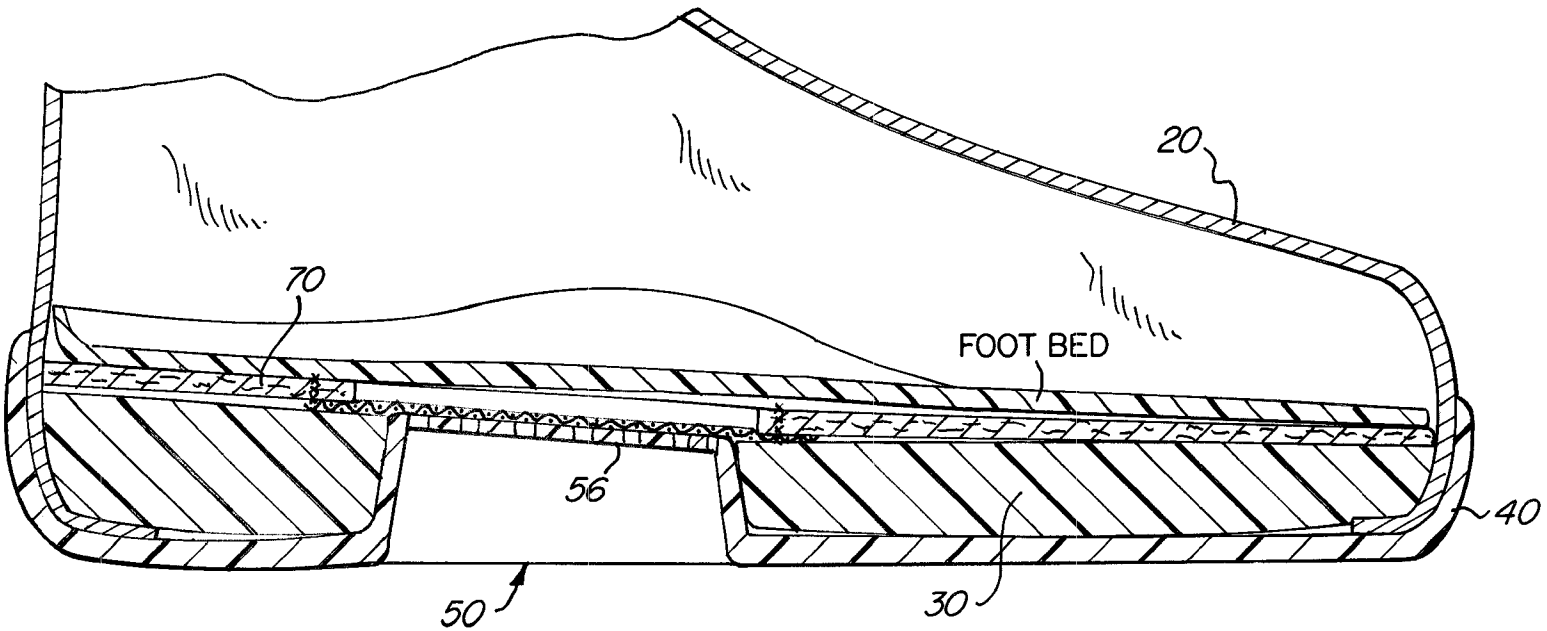
FIG. 6 depicts a cross sectional view of the shoe shown in FIG. 1.

Air shaft 50 includes at least one hole 54 extending from upper surface 52 to bottom surface 44 of sole, meaning hole 54 is a through hole passing through sole 40 and top surface 42 of sole 40. As shown in FIGS. 3 and 4, shaft 50 is integrally formed with top surface 42 of sole 40. However, this is not necessary for shoe 10 to properly function as shaft 50 may be separably attached to sole 40. Further, although shaft 50 is shown to have one hole, a plurality of holes may be used.

Air shaft 50 has a length L, shown in FIG. 4, of between approximately ¼ inch and approximately 2 inches long. In preferred embodiments, the length is between approximately ⅜ inch and approximately 1½ inches. In most preferred embodiments, the length is between approximately ½ and approximately ⅞ inch. The diameter of shaft 50, shown as D in FIG. 4, is between approximately ½ inch and approximately 3 inches. In preferred embodiments, the diameter is between approximately ¾ inch and approximately 2¾ inches. In most preferred embodiments, the diameter is between approximately 1 inch and approximately 2½ inches.

Given the diameter and length of shaft 50, a volume of air may be cupped, or entrapped, by shaft 50 as the user walks and brings shoe 10 downward toward the ground. As shoe 10 approaches the ground, the trapped volume of air is expected to move upward toward first filter 56 and into the interior of shoe 10. Moreover, because of the length of shaft 50, first filter 56 and second filter 72 are further away from the ground, which is expected to reduce the amount of moisture, should the ground be wet, from rising upward into the shoe 10. The traditional vent holes available in the prior art do not allow, because of their smaller diameter and/or shorter length, for a significant volume of air to be cupped or entrapped. Further, because of the shorter length, the vent holes of the prior art permit more moisture into the shoe than shaft 50.

It is understood that the diameter is merely the distance across shaft 50 and does not require shaft 50 to be round. In fact, shaft 50 may have any geometry or shape, such as being polygonal, square, triangular, and the like.

In further embodiments of shoe 10, shaft 50 is tapered upwardly toward filters 56, 72 to concentrate the entrapped air, and therefore increase the velocity of the air, as it moves into shoe 10.

Because first filter 56 may come in contact with rocks, sticks, or other abrasive debris on the ground, first filter 56 may be of the same material as sole 40. Because second filter 72 is closer to the user's foot, and may be attached to socklining 70 which may in turn be adapted to be in direct contact with the user's foot, second filter 72 is of a softer and more flexible material relative to first filter 56. More specifically, second filter 72 may be a woven mesh fabric.

Socklining 70 is secured to upper in any known or novel manner prior to securing upper to sole 40. Cushion 30, which has a height approximately the same as the distance shaft 50 projects upwardly from top surface 42. Cushion 30 includes hole 34 sized to fit around shaft 50 and socklining 70 also includes hole 74 sized to accommodate second filter 72.

What is claimed is:

1. A sole, comprising:
a bottom surface;
a top surface;
a shaft extending upwardly from said top surface;
said shaft having an upper surface;
a hole extending from said upper surface to said bottom surface through said sole and said shaft; and
said hole tapers upwardly to increase velocity of air trapped within said hole.

2. The sole according to claim 1, further comprising a first filter on said upper surface for inhibiting debris from entering a shoe through said hole.

3. The sole according to claim 2, further comprising a second filter placed on a side of said first filter opposite said hole for further inhibiting debris from entering the shoe through said hole and said first filter.

4. The sole according to claim 3, wherein said second filter has at least one aperture of a different size than at least one aperture of said first filter.

5. The sole according to claim 1, wherein said upper surface is between approximately ¼ inch and approximately 2 inches away from said bottom surface for inhibiting water or debris from entering a shoe.

6. The sole according to claim 1, wherein said hole is between approximately 1 inch and approximately 2½ inches long.

7. The sole according to claim 1, wherein said upper surface is between approximately ½ inch and approximately ⅞ inch away from said bottom surface for creating a vacuuming effect which promotes air to enter a shoe through said hole.

8. A shoe, comprising:
a sole including
a bottom surface;
a top surface;
a shaft extending upwardly from said top surface;
said shaft having an upper surface; and
a hole extending from said upper surface to said bottom surface through said sole and said shaft;
said hole tapers unwardly to increase velocity of air trapped within said hole;
a sock lining extending over said top surface and adapted to receive a user's foot; and
a spacer extending from said sock lining to said top surface to cushion the user's foot.

9. The shoe according to claim 8, further comprising a first filter on said upper surface for inhibiting debris from entering a shoe through said hole.

10. The shoe according to claim 9, further comprising a second filter placed on a side of said first filter opposite said hole for further inhibiting debris from entering the shoe through said hole and said first filter.

11. The shoe according to claim 10, wherein said second filter is secured to said sock lining.

12. The shoe according to claim 8, wherein said spacer is made of a resilient material.

13. The shoe according to claim 8, wherein said hole tapers upwardly to increase velocity of air trapped within said hole.

14. A shoe, comprising:
a sole including
a bottom surface;
a top surface;
a shaft extending upwardly from said top surface;
said shaft having an upper surface; and
a hole extending from said upper surface to said bottom surface through said sole and said shaft;
said hole tapers upwardly to increase velocity of air trapped within said hole;
a first filter on said upper surface for inhibiting debris from entering a shoe through said hole;

a socklining extending over said top surface and placed on a side of said first filter opposite said hole;

said socklining including a second filter for providing a second inhibitor for inhibiting debris from entering a shoe through said hole and said first filter; and a spacer extending from said socklining to said top surface to cushion the user's foot.

15. The shoe according to claim 14, wherein said hole is unobstructed in a location at least partially defined by a bottom perimeter of said upper surface of said shaft and said bottom surface of said sole.

* * * * *